US009567717B2

(12) United States Patent
Intagliata

(10) Patent No.: US 9,567,717 B2
(45) Date of Patent: Feb. 14, 2017

(54) PAVEMENT MARKER

(71) Applicant: ENERGY ABSORPTION SYSTEMS, INC., Dallas, TX (US)

(72) Inventor: John D. Intagliata, Antelope, CA (US)

(73) Assignee: Energy Absorption Systems, Inc., Dallas, TX (US)

( * ) Notice: Subject to any disclaimer, the term of this patent is extended or adjusted under 35 U.S.C. 154(b) by 0 days.

(21) Appl. No.: 14/209,053

(22) Filed: Mar. 13, 2014

(65) Prior Publication Data

US 2014/0270941 A1 Sep. 18, 2014

Related U.S. Application Data

(60) Provisional application No. 61/779,731, filed on Mar. 13, 2013.

(51) Int. Cl.
*E01F 9/06* (2006.01)

(52) U.S. Cl.
CPC ..... *E01F 9/553* (2016.02); *Y10T 29/4998* (2015.01)

(58) Field of Classification Search
CPC ..... E01F 9/06
USPC ..... 404/12, 14, 16
See application file for complete search history.

(56) References Cited

U.S. PATENT DOCUMENTS 2,192,878 A * 3/1940 Beebe ..... 404/10
2,260,498 A 10/1941 Wise
2,703,038 A * 3/1955 Shaw ..... 404/16
2,816,766 A * 12/1957 Stockfleth ..... F42B 6/08 473/584
3,587,416 A 6/1971 Flanagan
3,790,293 A 2/1974 Heenan et al.
3,809,487 A 5/1974 Flanagan
3,975,108 A * 8/1976 Suhr et al. ..... 404/16
3,980,410 A 9/1976 Suhr et al.
4,147,447 A * 4/1979 Heenan et al. ..... 404/16
4,155,666 A 5/1979 Flanagan
4,195,945 A 4/1980 Heenan
4,232,979 A * 11/1980 Johnson et al. ..... 404/16
D270,143 S 8/1983 Flanagan
4,402,628 A * 9/1983 Grenier ..... E01F 9/06 404/16
4,557,624 A 12/1985 Walker
4,577,992 A 3/1986 Jefferies
4,854,768 A 8/1989 Flanagan et al.
4,875,794 A 10/1989 Kern, Jr.
4,883,384 A 11/1989 Hedgewick
4,895,428 A 1/1990 Nelson et al.
5,074,706 A 12/1991 Paulos
5,078,538 A 1/1992 Montalbano
5,257,875 A 11/1993 Flanagan
(Continued)

OTHER PUBLICATIONS

International Search Report and the Written Opinion of the International Searching Authority issued in PCT Patent Application No. PCT/US2014/023035, mailed Jul. 9, 2014, 7 pages.

*Primary Examiner* — Thomas B Will
*Assistant Examiner* — Katherine Chu
(74) *Attorney, Agent, or Firm* — Brinks Gilson & Lione

(57) ABSTRACT

A pavement marker includes a plastic base having an exposed upper surface, a reflector supported by the plastic base, and a metal rub rail coupled to the plastic base. The rub rail has an exposed rub surface positioned above the exposed upper surface of the plastic base. Methods of making and installing a pavement marker are also provided.

18 Claims, 6 Drawing Sheets

(56) References Cited

U.S. PATENT DOCUMENTS

| | | | | |
|---|---|---|---|---|
| 5,277,513 | A * | 1/1994 | Flanagan et al. | 404/16 |
| 5,302,048 | A | 4/1994 | Paulos et al. | |
| 5,308,186 | A | 5/1994 | Hedgewick | |
| 5,454,664 | A * | 10/1995 | Siblik | 404/14 |
| 5,564,854 | A | 10/1996 | Hedgewick | |
| 5,677,050 | A | 10/1997 | Bilkadi et al. | |
| 6,050,742 | A | 4/2000 | Held et al. | |
| 6,062,766 | A | 5/2000 | Fleury et al. | |
| 6,102,612 | A * | 8/2000 | Pricone et al. | 404/13 |
| 6,116,812 | A * | 9/2000 | Hedgewick | 404/14 |
| 6,572,305 | B2 * | 6/2003 | Forrer | 404/16 |
| 7,025,527 | B2 * | 4/2006 | Mecham | 404/12 |
| 2003/0091388 | A1 | 5/2003 | Siblik | |
| 2004/0218976 | A1 | 11/2004 | Fleury | |
| 2008/0038058 | A1 * | 2/2008 | Forrer | E01F 9/06 404/14 |
| 2013/0202353 | A1 * | 8/2013 | De Jes s Chavarria Marroquin | E01F 9/06 404/16 |

* cited by examiner

PAVEMENT MARKER

This application claims the benefit of U.S. Provisional Application No. 61/779,731, filed Mar. 13, 2013, the entire disclosure of which is hereby incorporated herein by reference.

TECHNICAL FIELD

The present invention relates to pavement markers, and in particular, to pavement markers suitable for use in snow areas.

BACKGROUND

Traditionally, raised snow-plowable pavement marker bodies are made from hardened steel so that they are robust enough to withstand the punishment of being run over and scraped by a steel snow plow blade. These marker bodies are typically cast from iron and weigh in the range of 4 lbs. to 6 lbs. Although the marker bodies are set into the pavement with an adhesive, such as epoxy, they may sometimes dislodge and release from the road.

SUMMARY

In one aspect, one embodiment of a pavement marker includes a plastic base having an exposed upper surface, a reflector supported by the plastic base, and a metal rub rail coupled to the plastic base. The rub rail has an exposed rub surface positioned above the exposed upper surface of the plastic base.

In another aspect, one embodiment of a method of making a pavement marker includes molding a plastic base with a recess and an upper surface, disposing a metal rub rail in the recess, wherein the metal rub rail has an upper rub surface disposed above the upper surface of the plastic base, and connecting the rub rail to the base. The method further includes connecting a reflector assembly to the plastic base.

In another aspect, a method of installing a pavement marker includes forming a recess in the pavement, inserting an adhesive into the recess, and inserting a plastic base into the recess. The base includes a downwardly facing cavity, and the method includes pressing the adhesive into the cavity. The plastic base has an upper surface and a metal rub rail connected to the plastic base with an upper rub surface extending above the upper surface of said base. A reflector assembly is connected to the base beneath the upper rub surface.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "longitudinal," as used herein means of or relating to length or the lengthwise direction of a pavement marker. The term "lateral," as used herein, means directed toward or running perpendicular to the length of the marker, or from one side to the other of the marker. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" barriers may refer to any sequence of such marker components, and is not limited to the first and second marker components unless otherwise specified. The term "rigid" means the ability to resist relative movement between components. The term "flexible" means the ability of components to move relative to each other with little applied force. The term "plurality" means two or more, or more than one.

Figure 1:
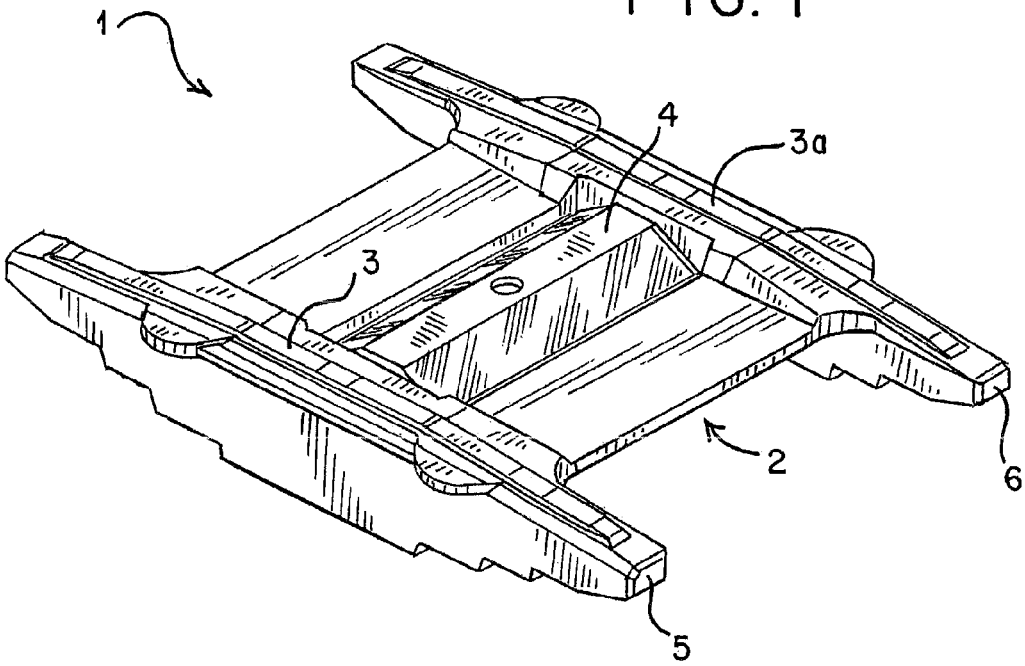
FIG. 1 is an isometric view of the snow-plowable marker assembly.
Figure 2:
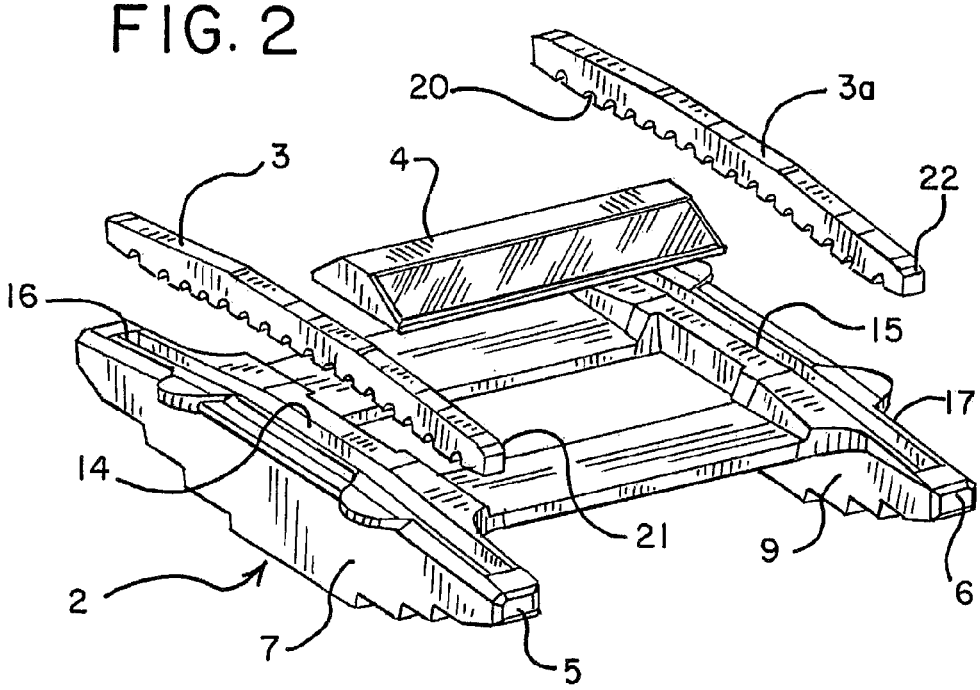
FIG. 2 is an exploded isometric view of the snow-plowable marker assembly.
Figure 3:
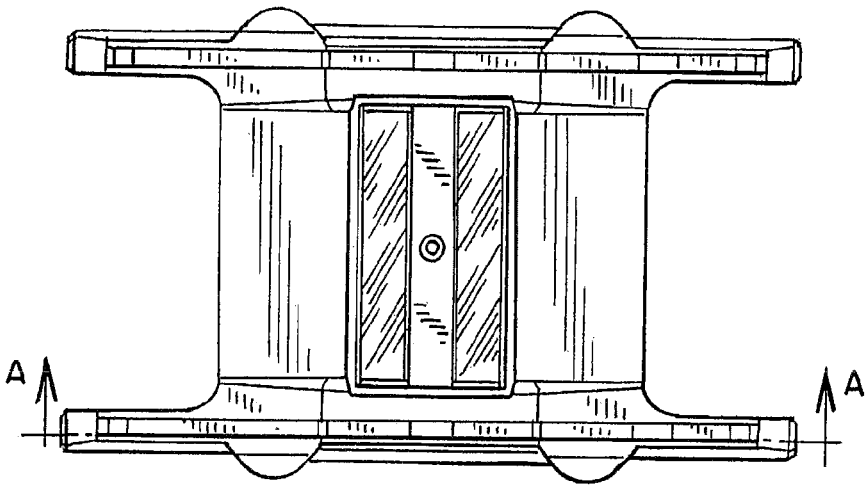
FIG. 3 is a top plan view of the snow-plowable marker assembly.

Referring to FIG. 1 and FIG. 2, embodiments of a system for a raised snow-plowable pavement marker are shown. A snow-plowable marker assembly 1 for delineating or marking roadways in snow areas is shown. The embodiment of the snow-plowable marker assembly 1 generally includes a marker body 2, a pair of rails 3 and 3*a* and a reflector assembly 4. When in service, the pavement marker 1 is embedded in the pavement 12 so as to project above the roadway surface 13. The projected portion of the marker allows the reflector 4 to be visible to passing vehicles from either direction of travel.

The marker body 2 is preferably injection molded as an integral unit from a light weight polymeric material and includes a pair of parallel, elongated, laterally spaced keel members 5 and 6, the keel member 5 having parallel substantially vertically extending inner and outer side surfaces 7 and 8, and the keel member 6 having parallel substantially vertically extending inner and outer side surfaces 9 and 10. One type of marker body is disclosed in U.S. Pat. No. 4,195,945, Heenan, the entire disclosure of which is hereby incorporated herein by reference.

The marker body 2 includes recessed pockets, or rail cavities, 14 and 15 as seen in FIG. 2 to which the steel rails 3 and 3*a* are set into. These recessed pockets, or rail cavities, 14, 15 are located on the top surface 16 and 17 of each keel 5 and 6 and are about ¼" wide and run the majority of the length of the keel 5, 6. The depth of the rail cavities is about 7/16" as measured from the keel top surface 16 and 17. The cavity bottom 18, shown in FIG. 4, follows the contour profile 19 of the rails 3, 3*a*.

Figure 10:
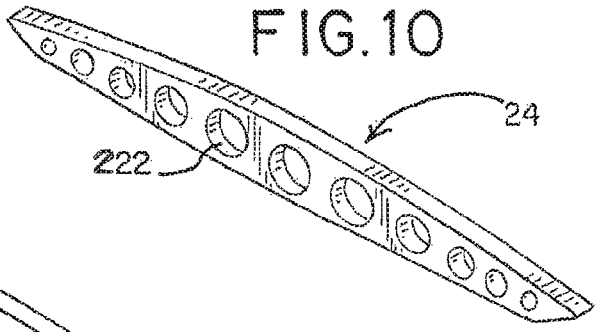
FIG. 10 is an isometric view of one rail embodiment outfitted with through holes.
Figure 9:
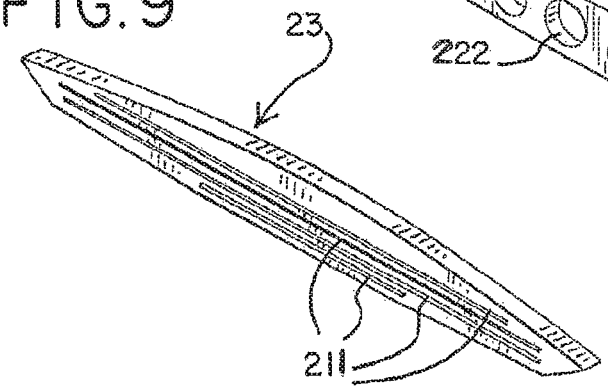
FIG. 9 is an isometric view of one rail embodiment outfitted with grooves.

The preferred method of securing the rails 3, 3*a* into the rail cavities 14, 15 is to integrate them into the molded body 2 during the injection molding process. The rail 3, 3*a* has notches 20 extending upwards into its bottom surface 19 which form an undercut shape, so that when the molten plastic flows around the rail 3, 3*a* it creates a positive locking geometric shape so that the rail 3, 3*a* remains fixed into the marker body 2. Other geometric shapes as shown in FIG. 9 and FIG. 10 can be used to secure the rails 3, 3*a* into the rail cavities 14, 15. Longitudinal grooves 211 create a positive locking means when the molten plastic solidifies into the grooves 211 of the rail embodiment 23. Another method to positively secure the rails 3, 3*a* into the rail cavities 14, 15 is to provide through holes 222 in the rail 24. Of course there are other methods, geometries and shapes that could be conceived where molten plastic could flow into to form a positive locking mechanism that would be obvious to one skilled in the art.

Figure 11:
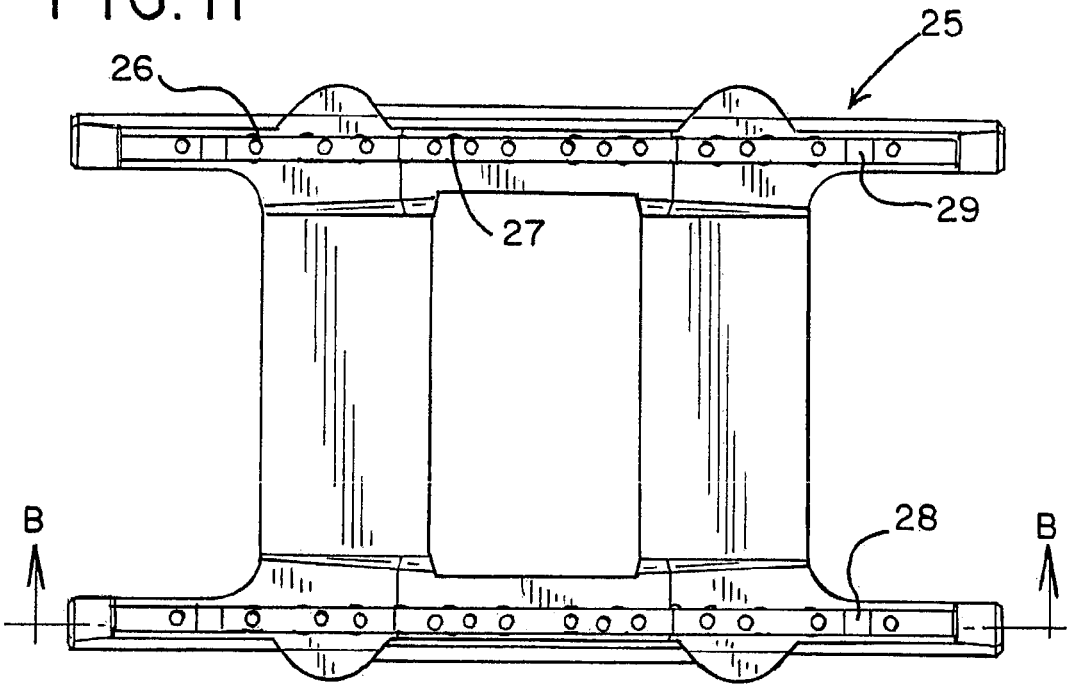
FIG. 11 is a top plan view of one embodiment of the snow-plowable marker body.
Figure 12:
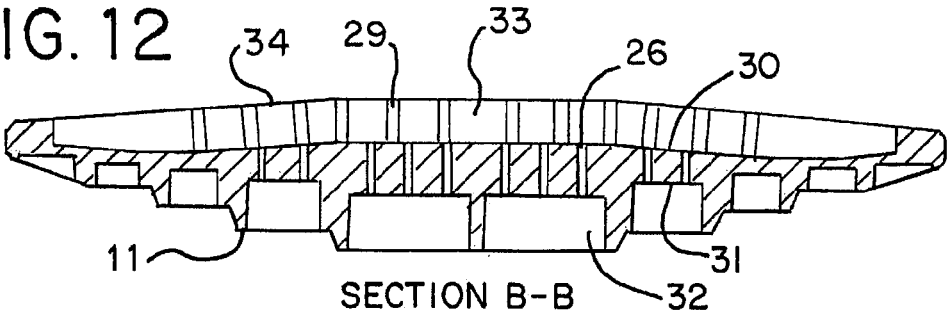
FIG. 12 is a section view taken along the line of B-B in FIG. 11.

Another method of securing the rails 3, 3*a* into the rail cavities 14, 15 is to bond them to the marker body 2 with an adhesive. One such adhesive that has been found to form a strong bond between both metal and plastic is epoxy. Referring to FIG. 11 and FIG. 12, another embodiment of a marker body 25 is outfitted with through holes 26 and notches 27 provided for the epoxy adhesive to escape as the rail 3, 3*a* is pressed into the rail cavity 28, 29. The through holes 26 are positioned between the rail cavity bottom surface 30 and the bottom surface 31 of the cavities 32 in the keel ledge 11. There is a plurality of through holes 26 positioned and spaced along the length of the rail cavity bottom 30 so that the uncured adhesive is free to flow out of the rail cavity 28, 29 as the rail 3, 3*a* is pressed into the rail cavity 28, 29. The through holes 26 are typically about 1/16" in diameter. The notches 27 are semi-circular in shape and they protrude into the rail cavity wall 33 by approximately 1/64". The plurality of notches are positioned between the keel top surface 34 and the rail cavity bottom surface 30.

Figure 15:
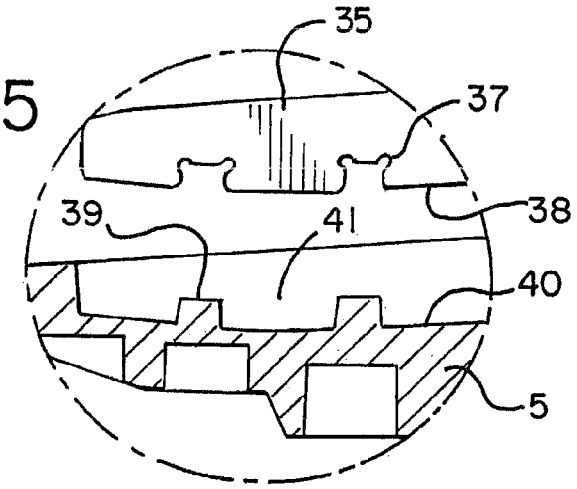
FIG. 15 is an enlarged detail view of FIG. 14.
Figure 16:
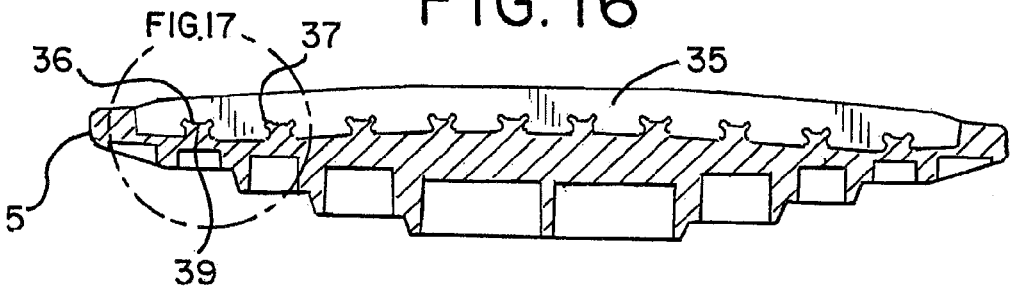
FIG. 16 is a cross-sectional view of the embodiment of FIG. 14 in an installed position.
Figure 17:
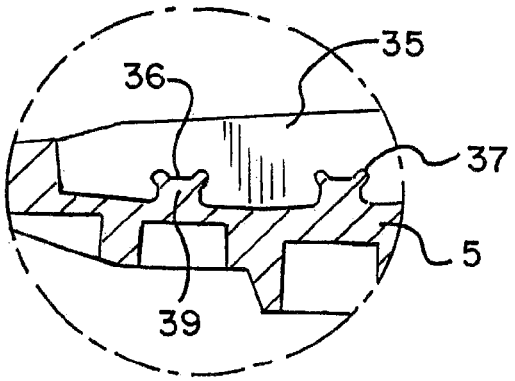
FIG. 17 is an enlarged detail view of FIG. 16.

Another method that the metal rails could be secured into the plastic marker body is by the heat staking process. Turning our attention now to FIG. 14 thru FIG. 17, the rail embodiment 35 is shown in an uninstalled position above the keel 5, shown in the cross-sectioned view of FIG. 14. A plurality of notches 36 with semi-circular undercuts 37 are located along the rail bottom edge 38. Conversely, a plurality of opposing protrusions 39 extend upwardly from the bottom surface 40 of the cavity 41 in the keel 5, the details of which are shown in FIG. 15. To assemble the rail 35 onto the keel 5, the rail 35 is heated and then pressed into the keel cavity 41, the details of which are shown in FIG. 16 and FIG. 17. When the now heated rail 35 contacts the protrusions 39 the plastic melts and flows into the notches 36, 37 creating an integrated unit. Once the plastic has cooled, the semi-circular undercuts 37 create a positive locking mechanism for which to secure the rail 35 in place. Of course one skilled in the art of the heat staking process could devise other shapes, geometries and pluralities of protrusions and notches that would be effective at achieving the desired results as described herein.

Figure 4:
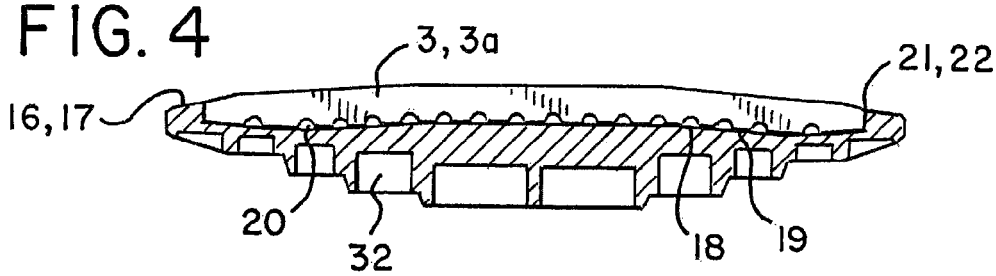
FIG. 4 is a section view taken along the line of A-A in FIG. 3.
Figure 5:
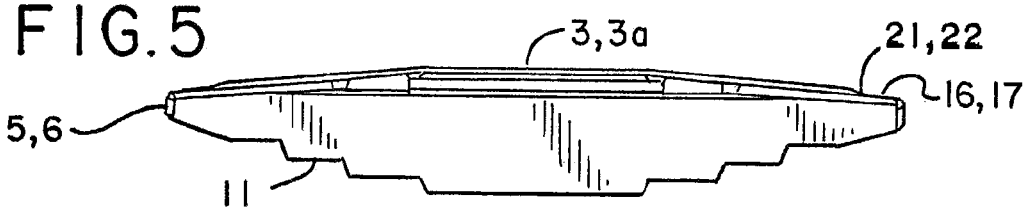
FIG. 5 is a side view of one embodiment of the snow-plowable marker assembly.

Referring now to FIG. 2, FIG. 4 and FIG. 5. When properly positioned in place, the rail ends 21 and 22, extend below the top surface 16, 17 of the keels 5, 6 so that they do not get snagged on the snow plow blade as it passes over the marker assembly 1.

Figure 6:
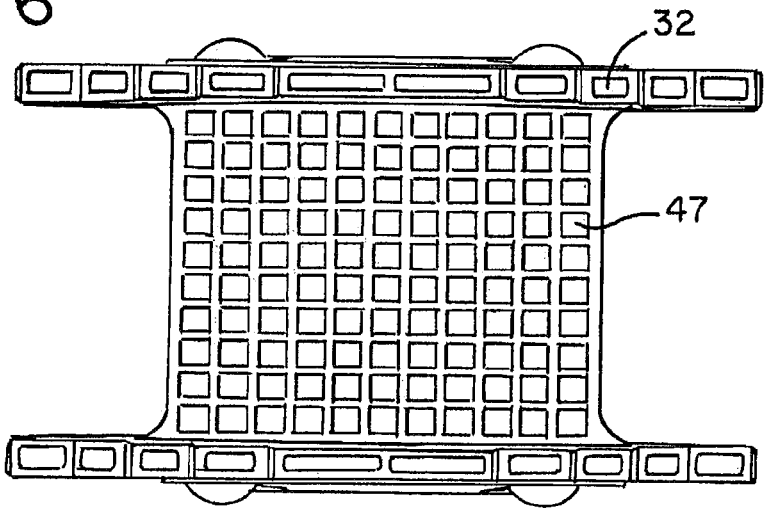
FIG. 6 is a bottom view showing the underside detail of the snow-plowable marker assembly.
Figure 7:
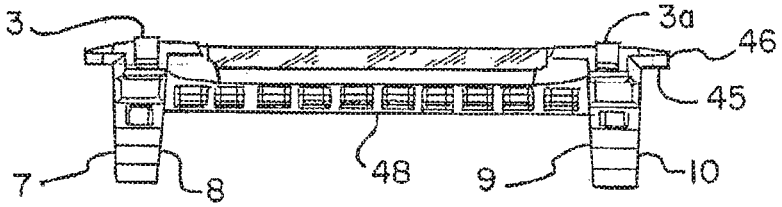
FIG. 7 is a front end view of the snow-plowable marker assembly.
Figure 8:
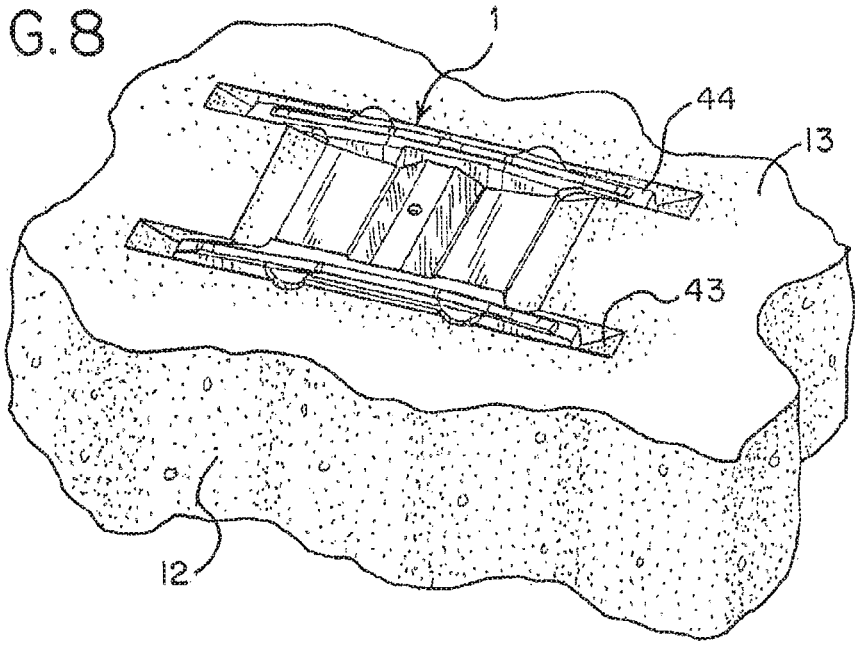
FIG. 8 is an isometric view of the snow-plowable marker assembly in service in a section of roadway.
Figure 13:
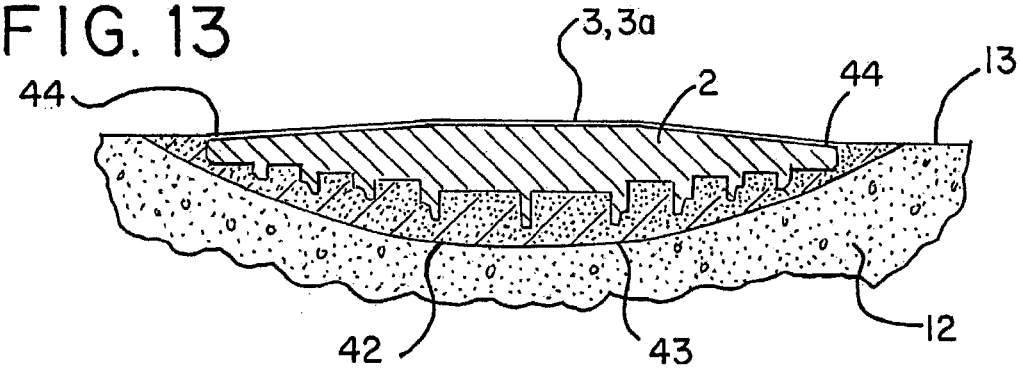
FIG. 13 is a cross-sectional view showing the snow-plowable marker embedded in the roadway.
Figure 14:
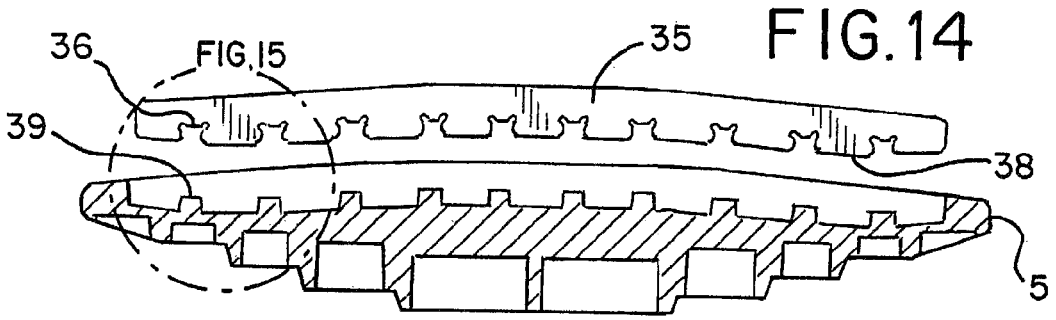
FIG. 14 is a cross-sectional view of one keel and rail embodiment in an uninstalled position.
Figure 18:
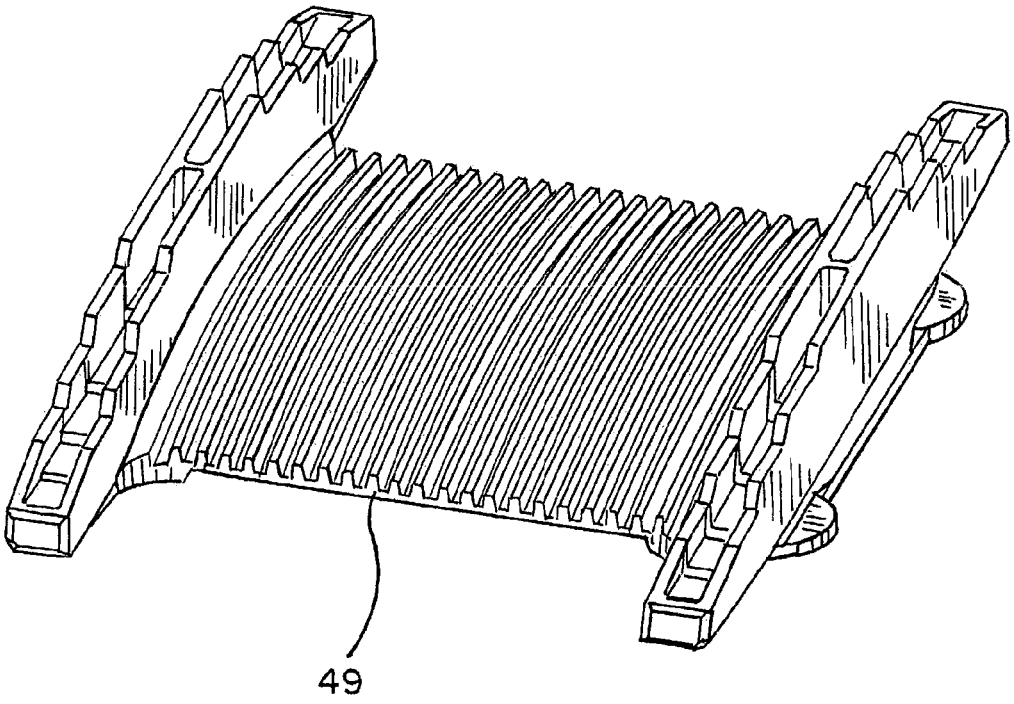
FIG. 18 is an isometric view showing the underside detail of one embodiment of the snow-plowable marker body.

When the snow-plowable marker 1 is in its serviceable condition installed in the pavement 12, as shown in FIG. 8 and FIG. 13, the ends of the keels 5, 6 are positioned below the pavement surface 13. The full details and disclosure about installing the raised pavement markers is detailed in U.S. Pat. No. 4,195,945, Heenan. The marker 1 rests in cavity 43, which is cut into the pavement 12. The cavity is curved and generally follows the contour of the bottom surface of the marker body 2. The vertical position of the marker 1 is determined by the bottom surface 45 of the positioning tabs 46 when they contact the top surface of the pavement 13. An adhesive 42, such as epoxy is used to secure the marker 1 to the pavement 12. Other adhesives used in the highway traffic industry could be used to secure the marker 1 into the pavement 12, such as hot melt bituminous products. An improvement over prior art snow-plowable pavement markers is a plurality of cavities 32, 47 populated along the underside 48 of the marker body 2 as shown in FIG. 6 and FIG. 7. The cavities become filled with adhesive 42 and provide extra gripping power to help retain the marker 1 in the pavement cavity 43. Another embodiment with a plurality of ribs is shown in FIG. 18. Longitudinal ribs 49 follow the contour of the curved underside of the marker body as another means to provide extra surface area for the adhesive to grip the marker. Of course, one skilled in the art would find a variety of other geometries and shapes to achieve the same result.

To ensure that the snow plow blade does not grab the marker 1 and dislodge it from its mounting, the tips 44 of the marker 1 are submerged below the pavement surface 13 and are covered with adhesive 42 as shown in FIG. 13.

As shown throughout the Figures, a lightweight snow-plowable raised pavement marker body is made out of plastic and has steel rails embedded in it. A reflector assembly rests in a depression in the center of the body and is protected from the snowplow blade by the steel rails. The steel rails protrude a distance above the plastic body so that the snowplow blade never comes in contact with the plastic portion of the marker. The marker is fixed into a depression in the roadway with an adhesive material.

Since the marker body made from light weight plastic, the marker will tend to deflect away from various objects if released from its mount. Inset into the marker plastic body is a pair of relatively thin hardened steel rails, which are designed to endure the abuse of snow plow blades. The plastic marker with the inset steel rails weighs approximately 1.2 lbs.

An improved pavement marker for use in snow areas is comprised of a lightweight plastic body and steel rails integrated into the plastic body. The overall marker dimensions and shape are such that it fits into standard plunge cut slots in the roadway surface. One such marker and installation technique is described in U.S. Pat. No. 4,195,945, Heenan.

One advantage of the embodiments of pavement markers described herein is that the pavement marker is about 75% lighter in weight than current cast iron snow-plowable raised pavement markers. This light weight is achieved by making the marker body from strong, durable, lightweight plastic material. One such material that has these properties is acrylonitrile butadiene styrene, commonly called ABS, although other strong lightweight polymeric materials may also be suitable. The marker body is formed into its shape by the injection molding process. The injection molding process would allow the parts to be made with exacting, repeatable tolerances at a rapid rate that is efficient in a manufacturing facility. Although, other manufacturing processes, such as additive manufacturing or CNC machining could be used to fabricate the marker body as one skilled in the art would appreciate.

The marker has four tabs, two on each side edge, that protrude about ⅜" from the outer side walls of the keels. The installer uses these tabs to set the marker at the correct height during the installation process. The top surface of the marker keels has a profile that gradually rises at an acute angle from the roadway surface.

A pair of steel rails is set into the plastic marker body keels. The rails follow the profile of the marker keel top surface and they protrude a small distance, approximately 1/16", above the top surface of the marker keels. The purpose of the steel rails is to protect the marker body and the reflector assembly from the scraping action of the snow plow blade as it passes over the marker. The steel rails are made from a grade of steel that is hardened to Durometer Rockwell C53-C56. This ensures that the rails do not easily wear down from the action of the steel snow plow blade passing over the marker.

In one embodiment, the steel rails are secured into the plastic marker body by in-molding the rails during the injection molding process. This is achieved by placing the rails into a designated position in the mold, then, as the plastic flows into the mold cavity, it encases the steel rails around it. The portion of the steel rails that contacts the plastic body has geometric features, such as notches, grooves and/or holes that grip the rails, creating a positive locking interface.

Another method of securing the rails into the marker body is to use an adhesive, such as epoxy, which is designed to bond dissimilar materials like plastic and metal. Again, geometric features, such as notches, grooves and/or holes, would allow the adhesive to flow into them and create gripping features that would help lock the rails into the marker body.

Heat staking is another method that could be used to secure the steel rails into the plastic marker body.

The plastic marker body includes pockets or cavities located in the bottom portion of the keels and extending upwardly towards the top surface of the arm. During installation, the adhesive material flows into the cavities and provides extra surface area to grip the marker body. Additional cavities are located on the underside of the curved mid-section belly of the marker body.

On the topside of the center area of the plastic marker body is a rectangular shaped depression, which accepts a standard reflector unit. One such reflector is manufactured by the 3M company and is disclosed in one or more U.S. Pat. Nos. 4,895,428 and 4,875,794 and 5,677,050, all of which are hereby incorporated herein by reference. The reflector assembly is outfitted with a patch of bituminous material that is used to secure the reflector to the pavement marker body. Other reflector units available in the marketplace fix to the marker body with epoxy or other adhesives.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A pavement marker comprising:

a plastic base having an exposed upper surface and a positioning portion having a bottom surface adapted to contact a top surface of a pavement;

a reflector supported by said plastic base; and a metal rub rail coupled to said plastic base, wherein said metal rub rail is embedded in said plastic base, and wherein said rub rail comprises a rail end, wherein an entirety of said rail end is positioned below said bottom surface of said positioning portion, and wherein said rub rail has a notch formed along a bottom surface of said rub rail, wherein said notch is filled by a material of said plastic base.

2. The pavement marker of claim 1 wherein further comprising a pair of said metal rub rails, wherein said pair of rub rails are spaced apart on opposite sides of said reflector.

3. The pavement marker of claim 2 wherein said plastic base comprises a pair of keels supporting said pair of rub rails, wherein said keels are connected with a cross member, wherein said reflector is connected to said cross member.

4. The pavement marker of claim 3 wherein said keels each comprise a downwardly directed cavity adapted to receive an adhesive material.

5. The pavement marker of claim 3 wherein said keels each comprise an upwardly directed recess, wherein said rub rails are disposed in said recesses.

6. The pavement marker of claim 1 wherein said rub rail has a plurality of notches formed along a bottom surface thereof.

7. The pavement marker of claim 1 wherein said rub rail comprises a straight, flat piece of metal.

8. The pavement marker of claim 1 wherein said plastic base and said rub rail weigh between 1 and 1.5 pounds.

9. The pavement marker of claim 8 wherein said plastic base and said rub rail weigh approximately 1.2 pounds.

10. The pavement marker of claim 4 wherein said cavity is defined by a side wall and front and rear walls.

11. A pavement marker comprising:

a plastic base having an exposed upper surface;

a reflector supported by said plastic base; and a metal rub rail embedded in said plastic base, and wherein said rub rail comprises a rail end positioned below said upper surface of said plastic base, and wherein said rub rail has a notch extending upwardly from a bottom surface of said rub rail, wherein said notch is filled by a material of said plastic base, and wherein said notch has a T-shape and comprises a mouth portion opening through said bottom surface of said rub rail, and a pair of opposite end portions extending away from said mouth portion.

12. The pavement marker of claim 11 wherein said opposite end portions have a semi-circular shape.

13. The pavement marker of claim 11 wherein said mouth portion has a first width, and wherein said notch has a second width defined between outer edges of said opposite end portions, wherein said second width is greater than said first width.

14. A method of making a pavement marker comprises:

molding a plastic base with a recess, an upper surface and positioning portion having a bottom surface adapted to contact a top surface of a pavement;

disposing a metal rub rail in said recess;

connecting said rub rail to said base, wherein said connecting said rub rail to said base comprises positioning an entirety of a rail end of said rub rail below said bottom surface of said positioning portion and filling in a notch formed along a bottom surface of said rub rail by flowing a plastic material into said notch; and connecting a reflector assembly to said plastic base.

15. The method of claim 14 wherein said connecting said rub rail to said base comprises in-molding said rub rail in said base while molding said base.

16. A method of installing a pavement marker comprises:

forming a recess in said pavement, said pavement having a top surface;

inserting an adhesive into said recess; and inserting a plastic base into said recess, wherein said plastic base comprises a downwardly facing cavity, an upper surface and a bottom surface, and thereby pressing said adhesive into said cavity, locating said base by engaging said top surface of said pavement with a bottom surface of a positioning portion of said plastic base, and wherein a metal rub rail is connected to said plastic base, wherein said metal rub rail is embedded in said plastic base, wherein said rub rail comprises a rail end, wherein an entirety of said rail end is positioned below said upper surface of said plastic base and below said top surface of said pavement, and wherein said rub rail has a notch formed in a bottom surface thereof, wherein said notch is filled by a material of said plastic base, and wherein a reflector assembly is connected to said base beneath said upper rub surface.

17. The method of claim 16 wherein said notch comprises a mouth portion communicating with a bottom surface of said rub rail, and a pair of opposite end portions extending away from said mouth portion.

18. The method of claim 14 wherein said notch comprises a mouth portion communicating with a bottom surface of said rub rail, and a pair of opposite end portions extending away from said mouth portion.

* * * * *